United States Patent [19]

Yoshida et al.

[11] 3,979,899

[45] Sept. 14, 1976

[54] DIGITAL DISPLAY TYPE ELECTRONIC TIME KEEPER

[75] Inventors: Masateru Yoshida, Itami; Yoshio Nakao, Tanashi, both of Japan

[73] Assignees: Mitsubishi Denki Kabushiki Kaisha; Citizen Watch Co., Ltd., both of Tokyo, Japan

[22] Filed: Apr. 1, 1975

[21] Appl. No.: 564,092

[30] Foreign Application Priority Data

Apr. 1, 1974 Japan ..... 49-36733

[52] U.S. Cl. ..... 58/4 A; 58/23 R; 58/23 BA; 58/50 R

[51] Int. Cl.[2] ..... G04B 19/24

[58] Field of Search ..... 58/4 A, 23 R, 23 C, 58/23 BA, 50 R; 340/336; 350/160 LC

[56] References Cited

UNITED STATES PATENTS

| | | | |
|---|---|---|---|
| 3,747,327 | 7/1973 | Uchiyama | 58/23 BA X |
| 3,796,037 | 3/1974 | Fujita | 58/50 R X |
| 3,802,182 | 4/1974 | Fujita | 58/23 BA X |
| 3,818,484 | 6/1974 | Nakamura et al. | 58/23 BA X |
| 3,842,589 | 10/1974 | Luce et al. | 58/23 BA X |
| 3,864,905 | 2/1975 | Richardson | 58/50 R |
| 3,886,726 | 6/1975 | Williams et al. | 58/23 R X |
| 3,889,459 | 6/1975 | Lu | 58/50 R X |

*Primary Examiner*—Ulysses Weldon
*Attorney, Agent, or Firm*—Oblon, Fisher, Spivak, McClelland & Maier

[57] ABSTRACT

A digital display type electronic time keeper is disclosed which has a time standard signal generating source having a crystal oscillating circuit. Means are provided for frequency-dividing the time standard signal, for counting the signal fed from the means for frequency-dividing the time standard signal which is driven by at least one power source, and for decoding the counted data. A display device having a positive dielectric anisotropy twisted effect type nematic liquid crystal is driven by the decoded signal. A booster using two phase signals taken from a part of the frequency dividing means provides a power source for driving the counting means, the decoding means and the display device. A level adjuster matches the output of the frequency-dividing means and the input of the counting means and is disposed therebetween. Additional means are provided for correcting the display data of the display device.

8 Claims, 10 Drawing Figures

DIGITAL DISPLAY TYPE ELECTRONIC TIME KEEPER

BACKGROUND OF THE INVENTION

1. Field of the Invention:

The present invention relates to a digital display type all-electronic time keeper which can be used instead of a conventional mechanical time keeper and a mechanical electronic time keeper.

2. Description of the Prior Art:

Recently, electronic time keepers including watches have been commercialized. A digital display type all-electronic watch using a liquid crystal as a display element has also been commercialized. However, a relatively high voltage has been required for a digital display type all-electronic time keeper with a liquid crystal.

SUMMARY OF THE INVENTION

It is an object of the present invention to provide a digital display type all-electronic time keeper which includes a twisted effect type nematic liquid crystal having positive dielectric anistropy (hereinafter referred to as a twist mode liquid crystal) rather than the conventional digital display type liquid crystal time keeper such as the indicator display type crystal watch or the crystal oscillation type DS mode digital liquid crystal time keeper.

The foregoing and other objects are attained in accordance with one aspect of the present invention through the provision of a digital display type electronic time keeper comprising: a time standard signal generating source comprising a crystal oscillating circuit; means for frequency-dividing the time standard signal; means for counting the signal fed from the means for frequency-dividing the time standard signal which is driven by at least one power source; means for decoding the counted data; a display device having a positive dielectric anisotropy twisted effect type nematic liquid crystal which is driven by the decoded signal; a booster using two phase signals taken from a part of the frequency dividing means which provide a power source for driving the counting means, the decoding means and the display device; a level adjuster for matching the output of the frequency-dividing means and the input of the counting means and being disposed therebetween; and means for correcting the display data of the display device.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

BRIEF DESCRIPTION OF THE PREFERRED EMBODIMENTS

Figure 1:
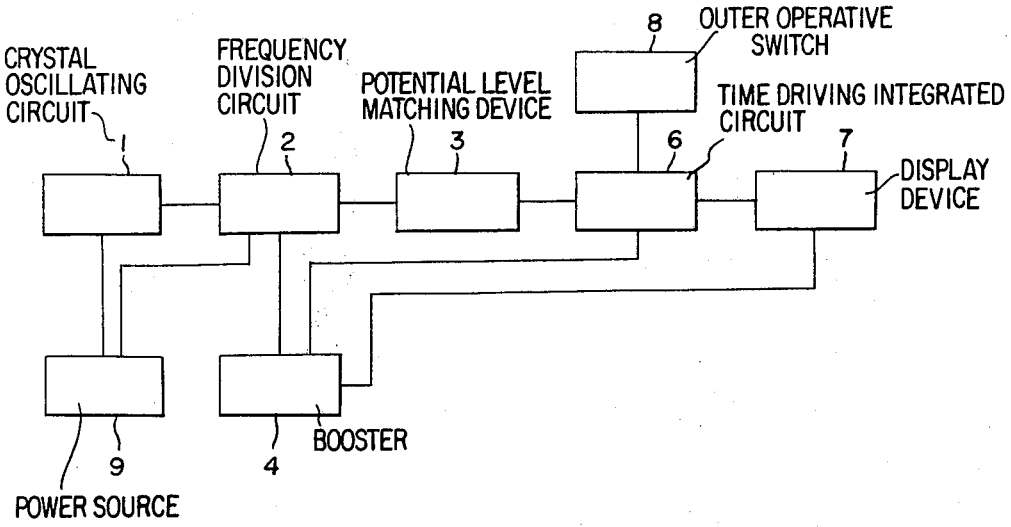
FIG. 1 is a block diagram of a digital display type all-electronic watch in accordance with the present invention.

Reference will now be made to the drawings wherein like reference numerals designate identical or corresponding parts throughout the several views.

The numeral reference 1 designates a crystal oscillating circuit; 2 designates a frequency division circuit; 3 designates a potential level matching device for connecting the frequency division circuit 2 and a time driving integrated circuit 6; 4 designates a booster for driving a display device 7; 8 designates an outer operative switch; and 9 designates a power source.

Figure 2:
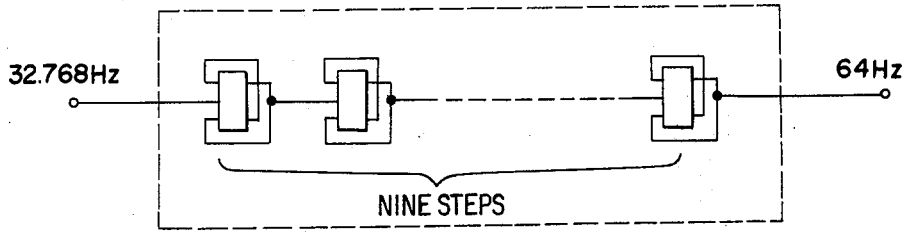
FIG. 2 is a frequency division circuit of FIG. 1 which provides an output of 64 Hz in nine steps.

The frequency divider used for the electronic watch of the invention is shown in FIG. 2 and has nine steps for frequency dividing to provide a signal having 64 Hz.

Figure 3:
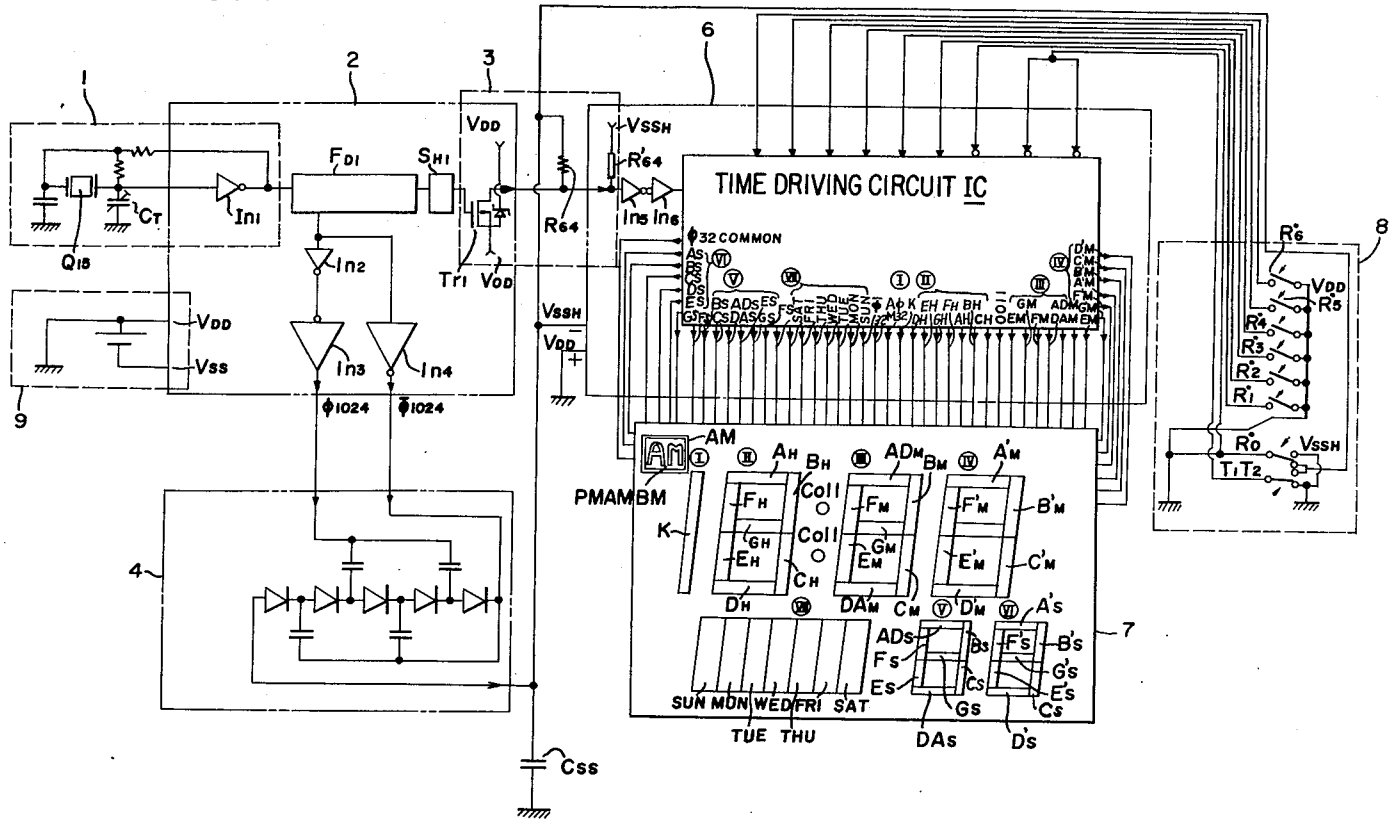
FIG. 3 is a circuit diagram of one embodiment of the main electronic circuit of the digital display type all-electronic watch using a twist mode liquid crystal.

The crystal oscillating circuit has a tuning fork type super miniature crystal oscillator $Q_{15}$ having a frequency of 32768 Hz. The crystal oscillating circuit 1 shown in FIG. 3 is finely adjusted by a frequency adjusting capacitor $C_T$ so as to correspond to the positive frequency.

An oscillation inverter $In_1$ is molded in one tip as an oscillation frequency division integrated circuit 2 together with output inverters $In_2$, $In_3$ and $In_4$ from frequency divider $F_{D1}$, a waveform shaping device $S_{H1}$, a transistor level-adjuster $Tr_a$; and a booster 4. The tip is assembled in the watch.

The frequency divider $F_{D1}$ is a flip-flop circuit as shown in FIG. 2 wherein nine steps for ½ frequency division are connected in series to output a signal having 64 Hz. The output signal having 64 Hz is input into the waveform shaping device $S_{H1}$ to form fine pulses whereby the transistor level adjuster $Tr_1$ is driven. The transistor $Tr_1$ receives the voltage boosted to about 5 volts by the booster integrated circuit 4.

The frequency divider $F_{D1}$ side is matched to the time driving integrated circuit 6 by the transistor $Tr_1$ together with the resistor $R_{64}$ and the MOS-R $R'_{64}$. The frequency of 1024 Hz in the 5th step of the frequency divider $FD_1$ is input through the inverters $In_3$, $In_4$ to the booster circuit 4. The booster circuit 4 is a Schenkel type booster circuit which is driven by two phase input signals $\phi$ 1024 and $\overline{\phi}$ 1024 to charge about 5 volts of DC voltage in the capacitor Css by four times voltage to provide the power source for driving the time driving integrated circuit 6 and the twist mode liquid crystal having positive dielectric anisotropy. The booster integrated circuit 4 is formed by molded hybrid integrated circuits and is assembled in the watch with the other integrated circuit tip.

The frequency divider $F_{D1}$ side is matched to the time driving integrated circuit 6 side by the transistor $Tr_1$, the resistor $R_{64}$ and the MOS-R $R'_{64}$.

The pulse having 64 Hz is input through the inverters $In_5$, $In_6$ to the time driving integrated circuit 6 to display the time on the display device 7.

In the switch operating part 8 for the outer operating device, a switch at terminal $R_6°$ operates date displays V, VI in the display device 7; a switch at terminal $R^{5°}$ provides quick correction of date displays V, VI; a switch at terminal $R_3°$ provides quick correction of the time display I, II; a switch at terminal $R_2°$ provides quick correction of minutes display III, IV; a switch at terminal $R_1°$ provides zero setting of second display V, VI; a switch at terminal $R_0°$ operates to set the time starting point and switches at terminal $T_1$ and $T_2$ operate to erase all displays.

The lead lines of the time driving integrated circuit 6 are connected to the corresponding parts of the symbols of I, II, III, IV, V, VI and VII; the seven segments of the display device and the symbols of the week day display device.

Figure 4:
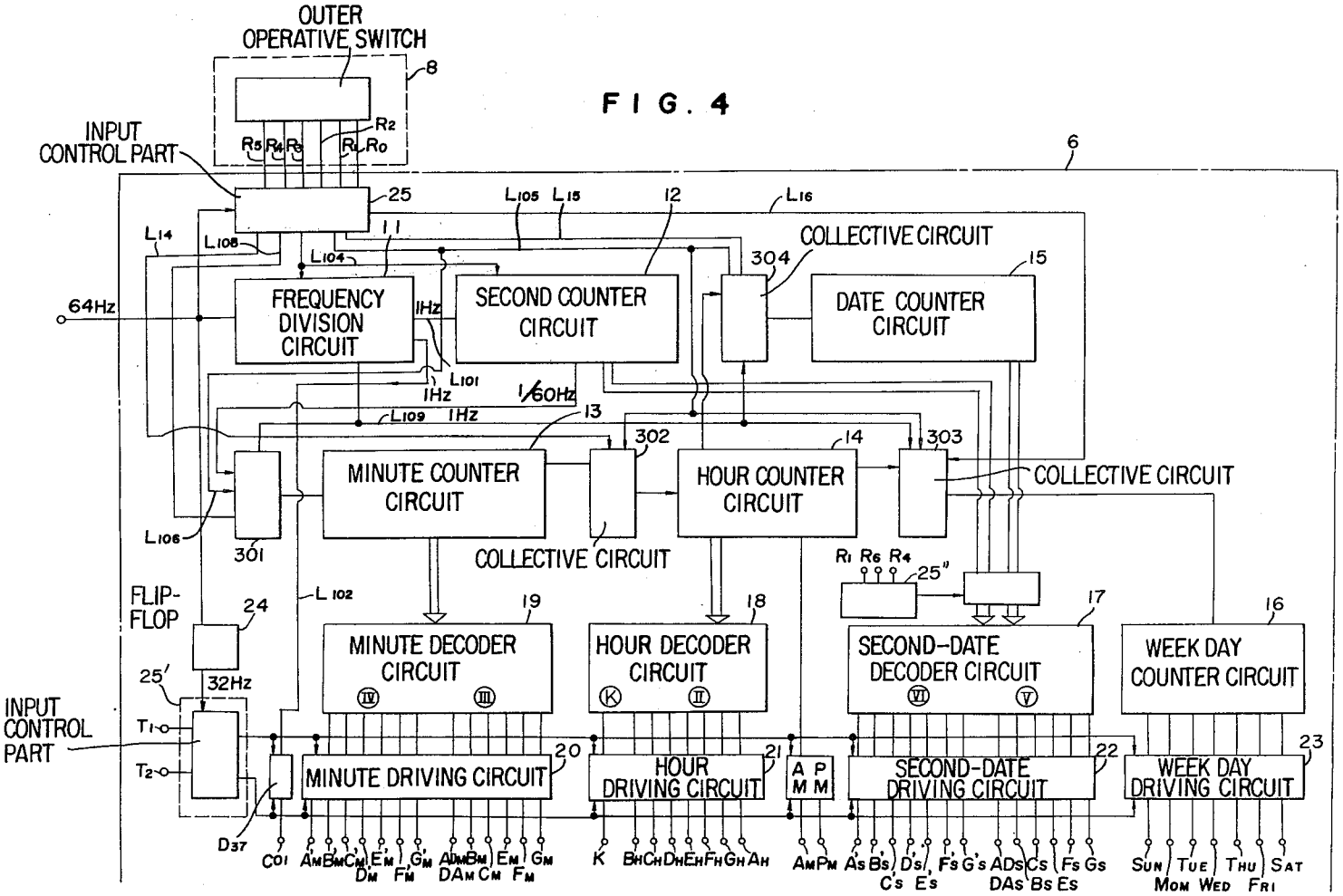
FIG. 4 is a block diagram of one embodiment of the time driving integrated circuit of FIG. 3.

FIG. 4 is a block diagram of the inner circuit of the time driving integrated circuit 6. The operation of the circuit 6 will now be described. As stated above, the signal of the frequency divider of FIG. 3 is applied through the level adjuster 3 and the inverters $In_5$, $In_6$ to the time driving integrated circuit 6 as fine clock pulses having 64 Hz. In the time driving integrated circuit 6, the signal is converted to 1 Hz by a frequency division circuit 11; is fed through a second counter circuit 12; is input to a minute counter circuit 13 as a minute signal; is input to an hour counter circuit 14 as an hour signal output; and is further input to the date counter circuit 15 and the week day counter circuit 16 as a date signal output.

The outputs of the counter circuits for second, minute, hour, date, etc. are applied to a second-date decoder circuit 17; an hour decoder circuit 18; and the minute decoder circuit 19 and further to a minute driving circuit 20; an hour driving circuit 21; a second-date driving circuit 22 and a week day driving circuit 23 which respectively correspond to the decoder circuits.

The driving circuits drive the display device by a signal having 32 Hz which is frequency-divided by flip-flop 24. The signal applied from input control part 25 as a result of the switch signal applied from the outer operating part 8 is fed to the correction circuit of each of the counter circuits corresponding to the switch signals to change the counting data and to correct the display of the display device.

FIGS. 5 A, B, C, D, E and F comprise a circuit diagram of one embodiment of the time driving integrated circuit 6 of FIG. 4. The embodiment will be described in detail with reference to the drawings.

The pulse signal of 64 Hz fed from the inverters $In_5$, $In_6$ is frequency-divided to provide 1 Hz by frequency divider 11 which comprises flip-flops $FF_{1-}$ – $FF_{15}$. The 1 Hz signal is applied to the line $L_{101}$. The signal having 1 Hz is counted by the second counter 12 which comprises flip-flops $FF_{16}$ –$FF_{21}$ and the counted value is demodulated by the second-date decoder circuit 17 to the display signal to drive the second-date driving circuit 22.

The driving circuits $D_1$ – $D_7$ of the driving circuit 22 drive the ten figure of the second display segment of FIG. 3. The terminals ADs. DAs, Bs, Cs, Ds, Es, Fs, and Gs are connected to the corresponding references of the second display segments V of FIG. 3. In like manner, the driving circuits $D_8$ – $D_{13}$ drive the second one figure of the seven second display segments.

The terminals As', Ds', Bs', Cs', Es', Fs' and Gs' are connected to the corresponding references of the second display segments of FIG. 3. The terminal ADs and DAs are commonly connected. In the minute display circuit, the one minute signal fed from the flip-flop $F_{22}$ of the second counter 12 is fed through the NOR gate $N_1$ of FIG. 5A and the corrective circuit 301 to the minutes counter 13 which comprises the flip-flops $FF_{22}$ – $FF_{29}$. The signal is converted to the minute signal by the decoder 19 to display the minute figures III and IV of FIG. 3.

Figure 5A:
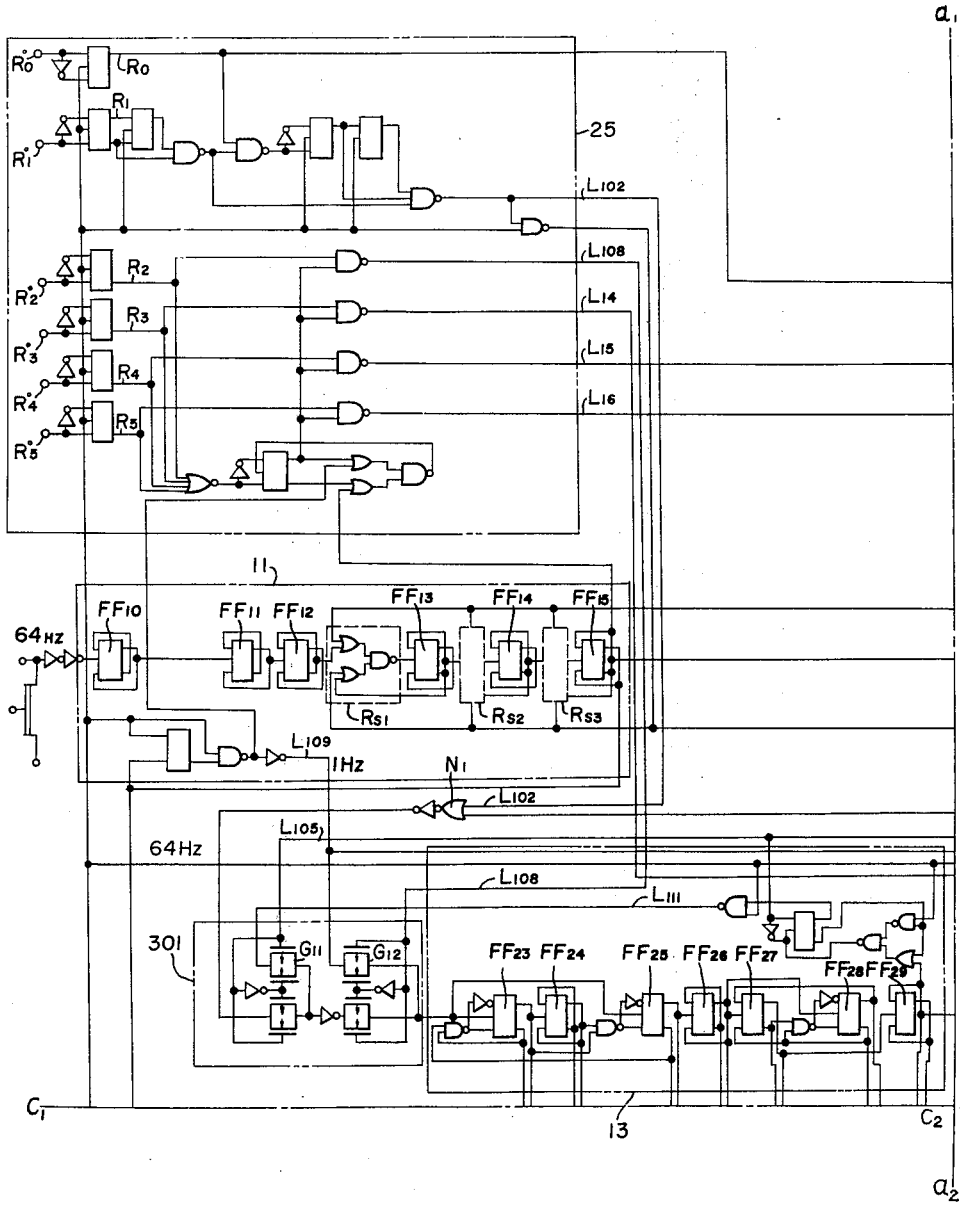
FIGS. 5A, B, C, D, E and F comprise a circuit diagram of one embodiment of the time driving integrated circuit of FIG. 4.
Figure 5B:
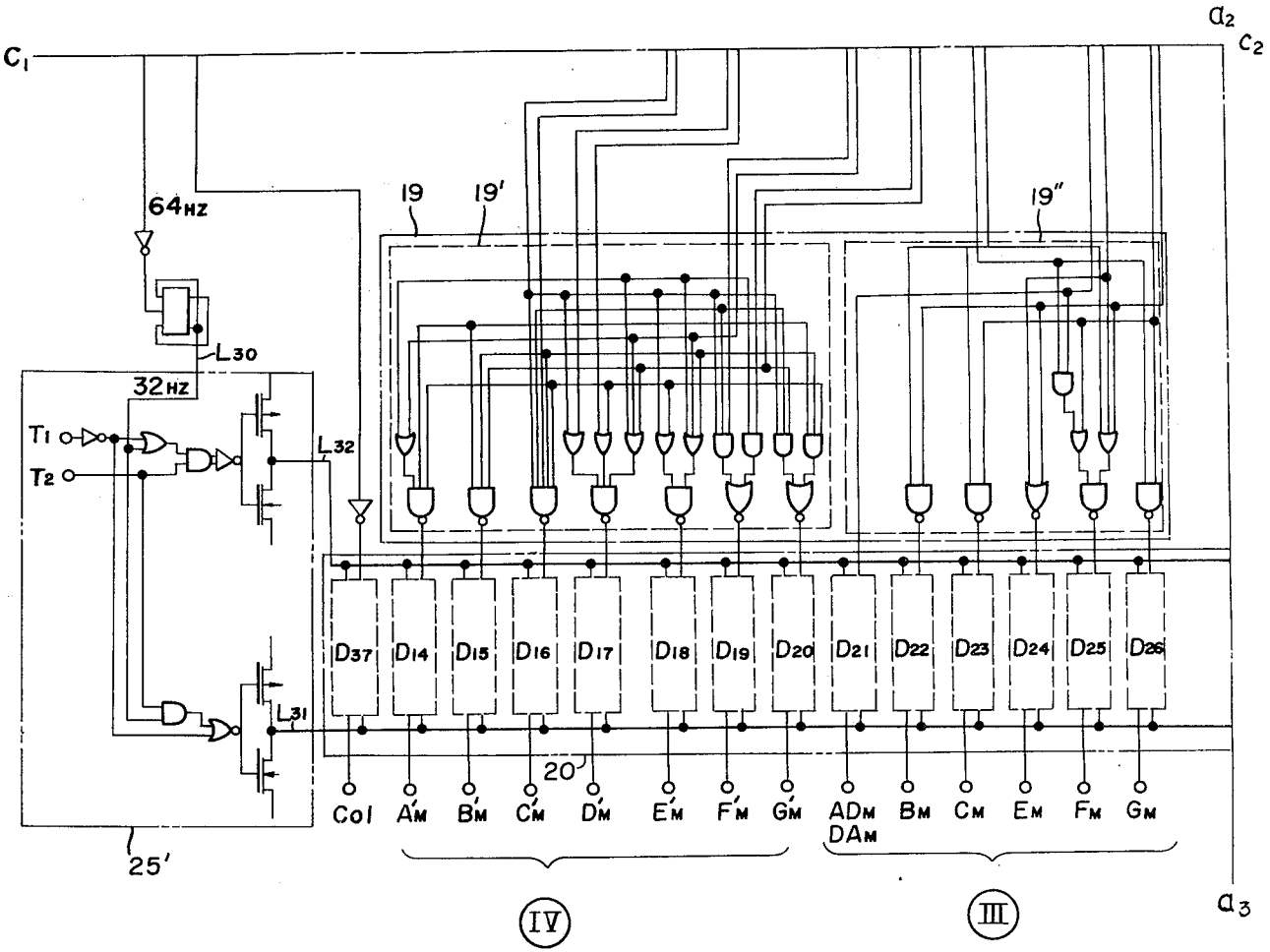
Figure 5C:
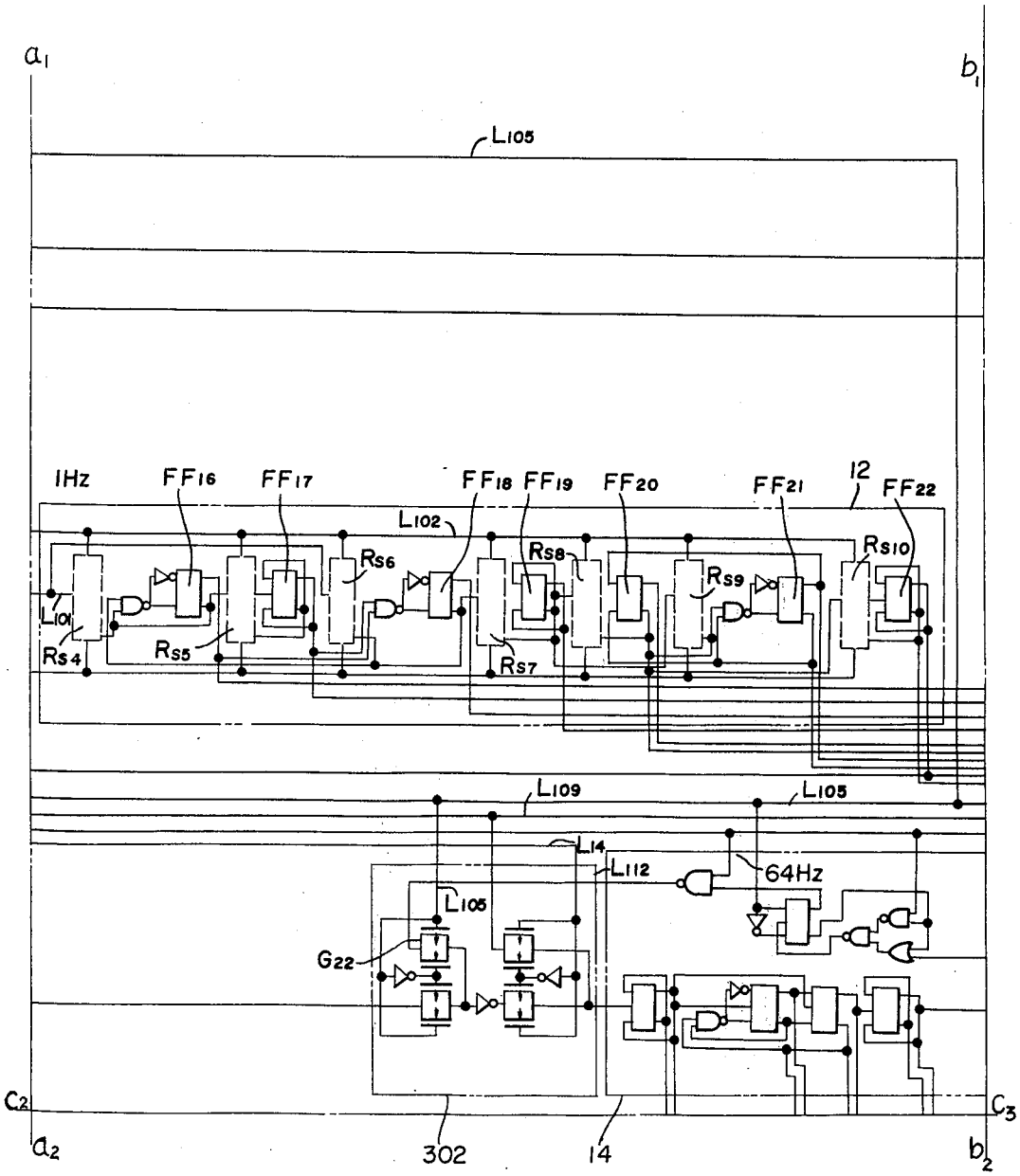
Figure 5D:
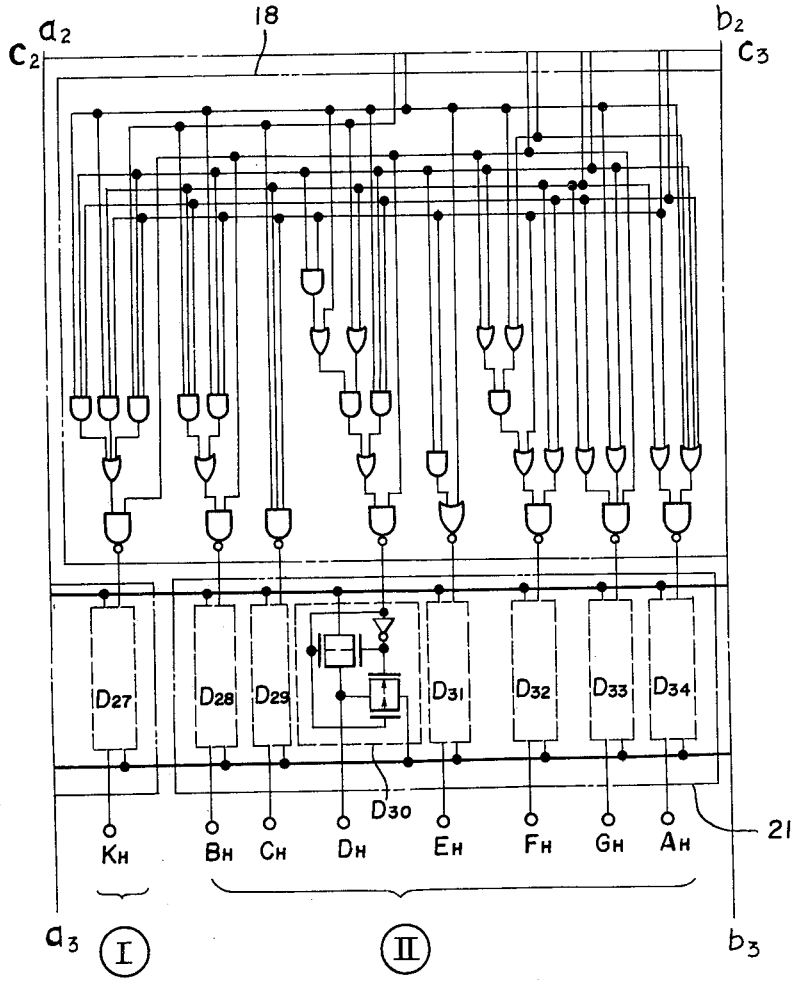
Figure 5E:
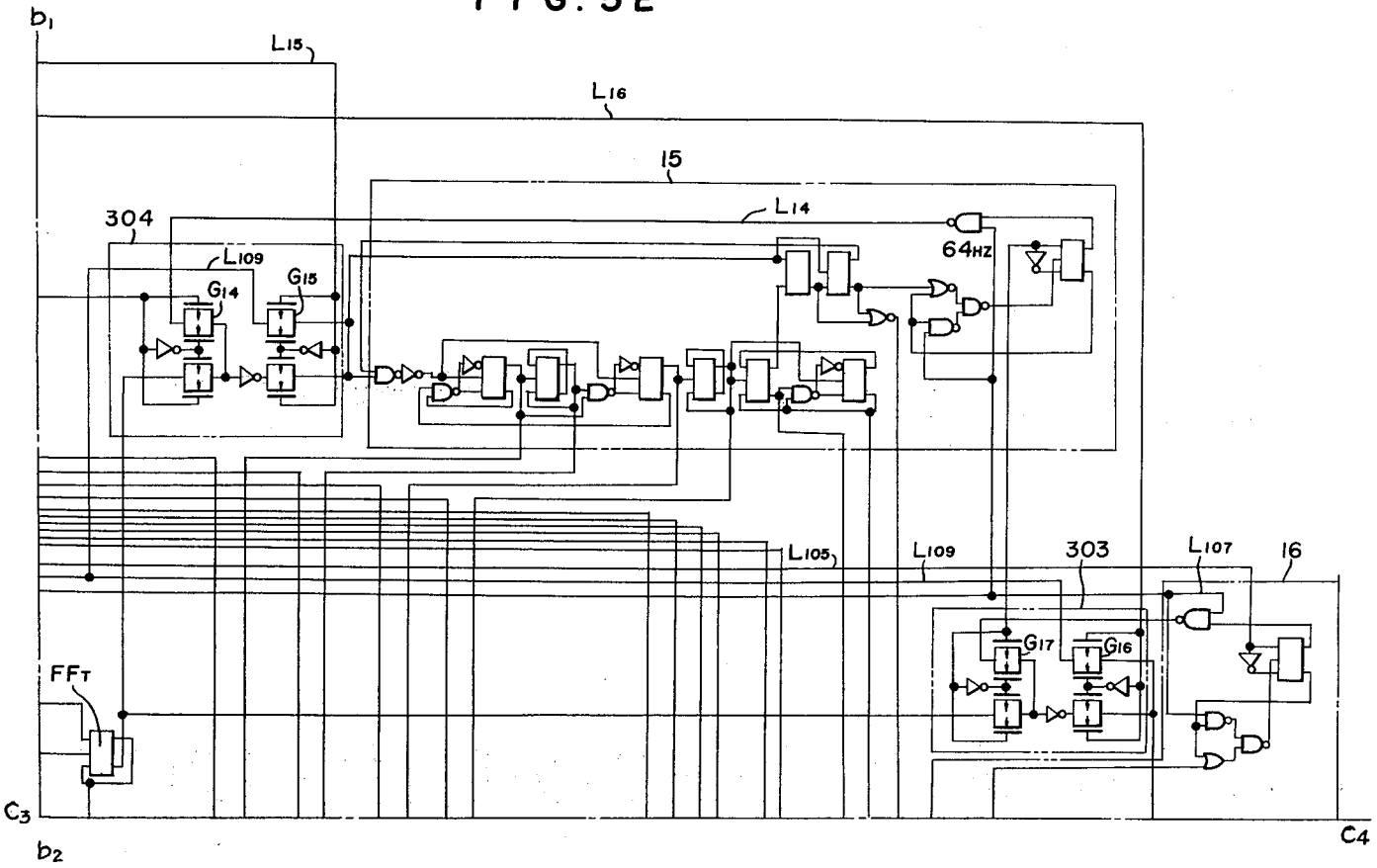
Figure 5F:
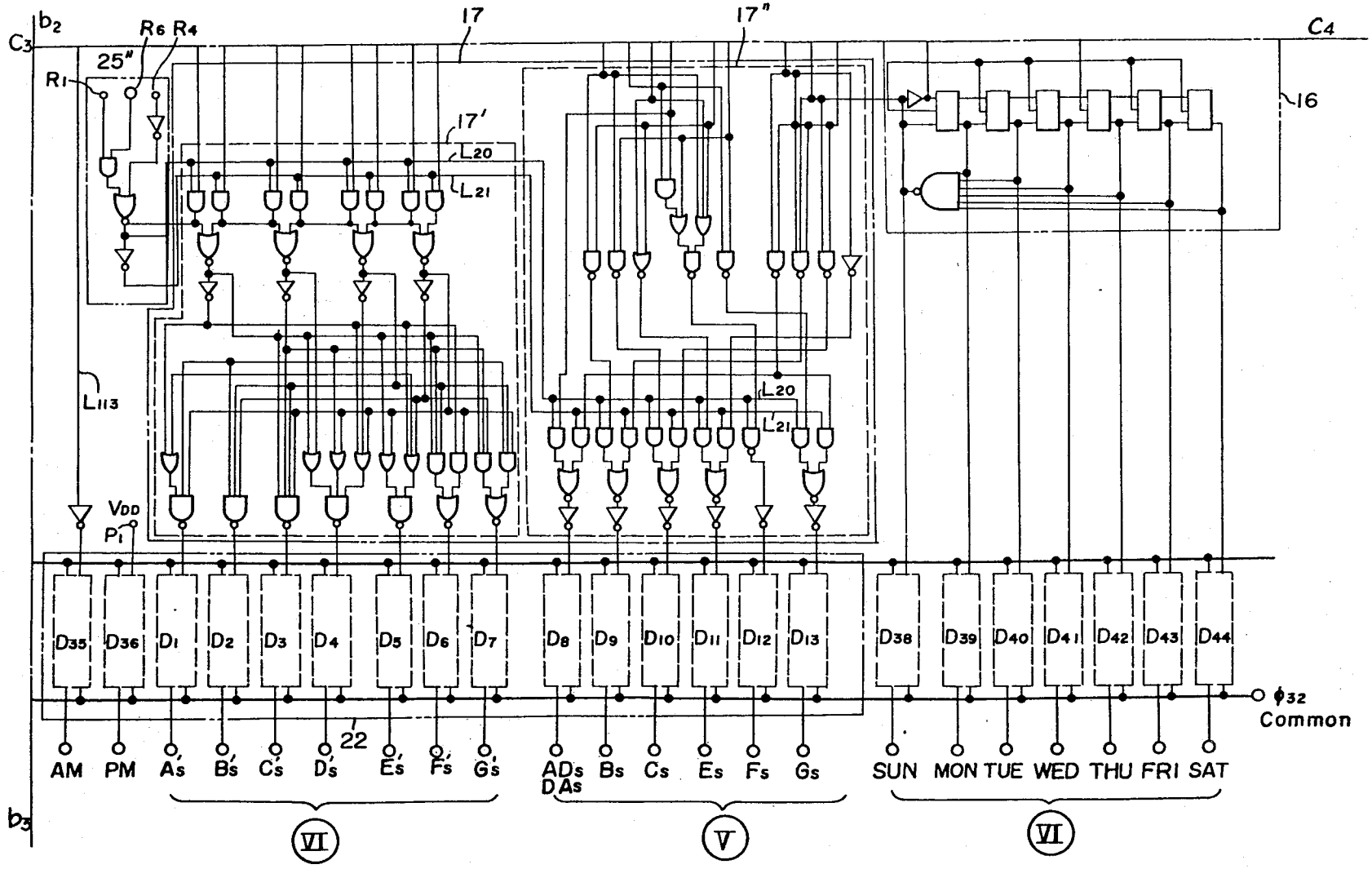

The output terminals of the minute driving circuits 20 of FIG. 5B correspond to the references of the seven minute display segments of FIG. 3.

The outputs of the counter 19 for the minute figure drive the driving circuits $D_{21}$ – $D_{26}$. The display signal of the minute ten figure is demodulated by the decoder 19''. The driving circuits $D_{21}$ – $D_{26}$ are respectively connected to the output terminals $B_M$, $C_M$, $F_M$, $E_M$, $G_M$, $AD_M$ and $DA_M$. The terminals $AD_M$ and $DA_M$ for driving the segments of the symbols of the minute ten figure III of FIG. 3 are commonly utilized.

The decoder 19' demodulates the minute one figure to drive the driving circuits $D_{14}$ – $D_{20}$ which are connected to the corresponding output terminals $A_M'$, $B_M'$, $C_M'$, $D_M'$, $E_M'$, $F_M'$ and $G_M'$ which are connected to the corresponding references of the seven segments $A_M'$, $B_M'$, $C_M'$, $D_M'$, $E_M'$, $F_M'$ and $G_M'$ of the minute one figure of FIG. 3.

The corrective circuit 301 is for one second quick correction for the minute display so that the terminal $R_2°$ of the input control part 25 is in high potential to keep the line $L_{104}$ in low potential to turn off the gate $G_{12}$. The one second signal fed from the line $L_{102}$ is taken from the line $L_{109}$ as the small duty signal having 1 Hz and the signal is applied to the counter 13 to provide the one second quick correction for the minute display.

The minute signal fed from the counter 13 is passed through the corrective circuit 302 to be counted in the counter 14. The signal is demodulated by the hour decoder 18 to drive the hour driving circuit 21. The output terminals $A_H$, $B_H$, $C_H$, $D_H$, $E_H$, $F_H$ and $G_H$ connected to the hour driving circuits $D_{27}$ – $D_{34}$ are connected to correspond to the references $A_H$, $B_H$, $C_H$, $D_H$, $E_H$, $F_H$ and $G_H$ of each segment of the seven segments II of FIG. 3. The output terminals $K_H$ of the driving circuit $D_{27}$ are connected to correspond to the reference $K_H$ of the segment I.

The output of the hour counter 14 is fed through the corrective circuit 303 to the date counter 15. The signal of the one figure is demodulated in the decoder 17 and the signal is fed to the driving circuits $D_1$ – $D_7$. The driving circuit terminals As', Bs', Cs', Ds', Es', Fs' and Gs' are connected to the corresponding references of As', Bs', Cs', Ds', Es', Fs' and Gs' of the segments to display the one figure of the date.

The signal for displaying the ten figure of the data fed from the date counter 15 is demodulated in the decoder 17'' to drive the driving circuits $D_8$ – $D_{13}$. The driving circuit terminals Bs, Cs, Es, Fs, Gs, ADs and DAs are connected to the corresponding references of the seven segments V of FIG. 3 to drive the ten figure. The terminals ADs, DAs are commonly connected.

The terminal $P_1$ is normally connected to the power voltage $V_{DD}$ and the terminal PM is commonly connected to the segment for displaying the PM of FIG. 3. When the decoder 21 provides the display of 12 o'clock by the signal of the hour counter 14, the driving signal is simultaneously applied to the AM terminal so that the AM segment and the frame AM' of FIG. 3 are commonly turned on. Accordingly, the indication of before noon is the AM display with the frame.

The signal fed from the date counter 15 is passed through the corrective circuit 303 to the ring counting circuit 16 and is fed to the week day display signal driving circuit 23. The driving circuit terminals Sun., Mon., Tue., Wed., Thu., Fri., and Sat. are connected to the corresponding week day of the week day display of FIG. 3 to provide a cycle drive.

The colon dot display of FIG. 3 turns on and off for 1 second by feeding the one second signal of the frequency divider 15 from the terminal col. through the line $L_{101}$ and the driving circuit $D_{37}$. The circuit diagram of the time driving integrated circuit 6 for driving the display device of FIG. 3 and the operation thereof and the signal path have previously been described.

The terminals and circuits 25, 25' and 25'' for operating and controlling the display device as the time keeper are shown in FIG. 4 and FIG. 5. These terminals are connected to the corresponding terminals 8 of FIG. 3.

During normal operation, the terminals $R_0°$, $R_1°$, $R_2°$, $R_3°$, $R_4°$, $R_5°$ and $R_6°$ are in the OFF state and the terminals $R_0$, $R_1$, $R_2$, $R_3$, $R_4$ and $R_5$ are in the high potential state. When the terminal $R_0°$ is switched to high potential from the normal work state, the line $L_{105}$ is switched to low potential whereby the voltage circuits 301, 302, 303 and 304 are connected to the line $L_{105}$.

In the corrective circuit 301, when the line $L_{105}$ is switched to low potential, the gate $G_{11}$ applies the signal having 64 Hz fed from the line $L_{111}$, as a quick correction signal, to the minute counter 13 to provide a quick correction of the correct time of the minute counter. The output of the minute decoder 19 is fed to the driving circuit 20 to correct the seven minute display segments III and IV to display the 00 minute.

The signal of the line $L_{105}$ is fed through the corrective circuit 302 to enable the gate $G_{22}$ to apply the signal having 64 Hz fed through the line $L_{112}$ to the hour counter 14 to provide the quick correction of the hour counter 14. The signal of the hour counter is applied to the decoder 18 to correct the seven segments I and II connected to the driving circuits $D_{27} - D_{34}$ to display 12 o'clock.

At the same time, the line $L_{113}$ connected to the flip-flop $FF_f$ of the counter is switched to low potential to drive the AM display driving circuit $D_{35}$ to drive the AM display segments of FIG. 3. The signal fed from the line $L_{105}$ is applied to the corrective circuit 34 to enable the gate $G_{14}$ to apply the quick correction signal having 64 Hz fed from the line $L_{14}$ to the decoder 17 connected to the date counter 15 to correct the segments to display the 31 date. The signal fed from the line $L_{105}$ enables the gate $G_{17}$ of the corrective circuit 303 to apply the quick correction signal having 64 Hz fed from the line 107 to the ring counter 16 to display Sunday.

When the terminal $R_1$ is switched to low potential by the input control switch terminal $R_1°$, the low potential signal of the line $L_{102}$ is applied to the corrective circuits $R_{S1} - R_{S10}$ for the flip-flops $FF_{13} - FF_{21}$ to reset the flip-flops to zero. Thus, the flip-flops of shorter than 1/8 second are reset, the zero signal is applied to the decoder and the driving circuit 22 is driven to reset the second display to 00 second.

When the control switch terminal $R_2°$ is turned on, the line $L_{108}$ is switched to low potential to enable the gate $G_{12}$ of FIG. 5 to apply the one second signal fed from the line $L_{109}$ to the minute counter 13 to obtain the quick correction of the minute display for 1 second.

When the control switch terminal $R_3°$ is turned on, the signal fed from the line $L_{14}$ enables the gate $G_{13}$ of FIG. 5 to apply the one second signal fed from the line $L_{109}$ to the counter 14 to obtain the quick correction of the hour display for 1 second.

When the control switch terminal $R_4°$ is turned on, the signal fed from the line $L_{15}$ enables the gate $G_{15}$ of FIG. 5 to apply the one second signal fed from the line $L_{109}$ to the counter 15 to obtain the quick correction of the date display for 1 second.

When the control switch $R_5°$ is turned on, the signal fed from the line $L_{16}$ is applied to the gate $G_{16}$ to enable the gate to apply the one second signal fed from the line $L_{109}$ to the ring counter 16 to obtain the quick correction of the week day display for 1 second.

When the terminal $R_4$ of the input control part 25'' is turned on, the line $L_{20}$ in the date-second decoder 17 is switched to low potential and the signal fed from the counter 15 is only demodulated to display the date display. When the terminal $R_4°$ is turned on in this condition, the quick correction of the date display is obtained. When the control terminal $R_6$ is switched to low potential under the condition of low potential of the terminal $R_4$ of the input control part 25'', the line $L_{21}$ is switched to low potential and the line $L_{26}$ is switched to high potential whereby the decoder 17 demodulates the second display signal fed from the second counter 12 to display the second in the seven segment display V, VI of FIG. 3. That is, when the terminal $R_4$ is at a high potential, the date display is obtained regardless of the condition of the terminals $R_1$, $R_6°$ of FIG. 5.

When the terminal $R_4$ is at a low potential, the quick correction of the date display for 1 second is obtained by the signal fed from the line $L_{109}$. In this case, when the terminal $R_6°$ is at a low potential, the date display is switched to the second display. When the terminal $R_1$ is at a low potential, the line $L_{21}$ is switched to a low potential and the second display is reset to zero.

The terminals $T_1$, $T_2$ of the input control part 25' are respectively a terminal for testing and a terminal for display erasing. During the normal operation, both terminals $T_1$, $T_2$ are at a high potential and the signal having 32 Hz fed from the line $L_{30}$ is applied to the driving circuits. The liquid crystal driving segments are driven by the AC signal having 32 Hz fed from the decoders.

When one of the terminals $T_1$, $T_2$ is at a low potential, one of the lines $L_{31}$, $L_{32}$ is at a high potential and the other is at a low potential whereby the driving circuit is driven by DC power to test it. When both of the terminals $T_1$, $T_2$ are at a low potential, both of the lines $L_{32}$, $L_{31}$ are at the same potential level so that the driving circuit is not actuated to thereby prevent current consumption. That is, the time keeping functional circuit is operated but the display circuit which causes high current consumption is in its OFF state. The functional operation of the time driving integrated circuit of FIG. 3 has previously been described.

The mechanism of the digital time keeper of the invention has an integrated circuit having multi-functional display functions for displaying hour, minute, second as well as AM or PM, date and week day at high efficiency so that the time keeper can be made rather compact. Further, the power source can be a solar battery and a chargeable secondary battery or a combination of a solar battery and a commercial battery.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States:

1. A digital display type electronic time keeper comprising:

a crystal oscillating circuit for generating a time standard signal, a frequency division circuit for frequency dividing the time standard signal, a time driving integrated circuit for counting the frequency divided time standard signal from the frequency division circuit and for decoding the counted frequency divided time standard signal, a potential level matching device for matching the output of the frequency division circuit and the input of the time driving integrated circuit, a display device driven by the decoded counted frequency divided time standard signal comprising a positive dielectric anistropy twisted effect type nematic liquid crystal, a booster for driving the time driving integrated circuit and the display device from two phase signals from the frequency division circuit, an outer operative switch for correcting the display device, a power source for driving the crystal oscillating circuit and the frequency division circuit, means connecting the input of the crystal oscillating circuit to a first output of the power source, means connecting a second input of the frequency division circuit to a second output of the power source, means connecting the output of the crystal oscillating circuit to a first input of the frequency division circuit, means connecting a first output of the frequency division circuit to the input of the booster, means connecting a first output of the booster to a second input of the time driving integrated circuit, means connecting a second output of the booster to a second input of the display device, means connecting a second output of the frequency division circuit to the input of the potential level matching device, means connecting the output of the potential level matching device to a first input of the time driving integrated circuit, means connecting the output of the outer operative switch to a third input of the time driving integrated circuit, means connecting the output of the time driving integrated circuit to a first input of the display device, the display device comprising seven separate segment type displays for hour and minute; a single display for selectively showing second or date by seven segment displays under the selective switching control of said outer operative switch; additional displays for week day, AM, PM; and a colon dot display which turns on and off for one second between the displays of hour and minute.

2. The digital display type electronic time keeper according to claim 1 wherein the crystal oscillating circuit, the frequency division circuit, the potential level matching device and the time driving integrated circuit comprise C-MOS integrated circuits and the booster comprises a Schenkel type hybrid integrated circuit.

3. The display type electronic time keeper according to claim 1 wherein the frequency division circuit comprises nine steps and generates a 64 Hz signal.

4. The display type electronic time keeper according to claim 1 wherein the crystal oscillating circuit comprises a tuning fork miniature crystal oscillator having a frequency of 32768 Hz.

5. The display type electronic time keeper according to claim 1 wherein the booster comprises molded hybrid integrated circuits.

6. The display type electronic time keeper according to claim 1 wherein the power source comprises a solar battery.

7. The display type electronic time keeper according to claim 1 wherein the power source comprises a solar battery and a chargeable secondary battery.

8. A digital display type electronic time keeper comprising:

a crystal oscillating circuit for generating a time standard signal, a frequency division circuit for frequency dividing the time standard signal, a time driving integrated circuit for counting the frequency divided time standard signal from the frequency division circuit and for decoding the counted frequency divided time standard signal, a potential level matching device for matching the output of the frequency division circuit and the input of the time driving integrated circuit, a display device driven by the decoded counted frequency divided time standard signal comprising a positive dielectric anisotropy twisted effect type nematic liquid crystal, a booster for driving the time driving integrated circuit and the display device from two phase signals from the frequency division circuit, an outer operative switch for correcting the display device, a power source for driving the crystal oscillating circuit and the frequency division circuit, the outer operative switch comprising:

a first control switch for displaying the initial conditions 00 seconds, 00 minutes, hour 12 AM, day 31 and Sunday, a second control switch for controlling seconds, a third control switch for controlling minutes, a fourth control switch for controlling hours, a fifth control switch for controlling dates, a sixth control switch for controlling week days, a seventh control switch for controlling date-second displays, an eighth control switch to erase all displays, the fifth control switch when activated causing display of a date regardless of the conditions of the second and seventh control switches, the fifth control switch when not activated causing display of seconds regardless of the condition of the seventh control switch when the second control switch is in its active state, the seventh control switch being capable of changing the date display or second display when the second and the fifth control switches are non-activated.

* * * * *